US012692804B2

(12) United States Patent
Weber et al.

(10) Patent No.: US 12,692,804 B2
(45) Date of Patent: Jul. 28, 2026

(54) ACTUATING GEAR AND METHOD FOR ASSEMBLING AN ACTUATING GEAR OF AN ELECTROMECHANICAL CAMSHAFT ADJUSTER

(71) Applicant: Schaeffler Technologies AG & Co. KG, Herzogenaurach (DE)

(72) Inventors: Juergen Weber, Erlangen (DE); Resat Aras, Fürth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/567,804

(22) PCT Filed: Jun. 3, 2022

(86) PCT No.: PCT/DE2022/100418
§ 371 (c)(1),
(2) Date: Dec. 7, 2023

(87) PCT Pub. No.: WO2022/258109
PCT Pub. Date: Dec. 15, 2022

(65) Prior Publication Data

US 2024/0263571 A1 Aug. 8, 2024

(51) Int. Cl.
*F01L 1/352* (2006.01)

(52) U.S. Cl.
CPC ..... *F01L 1/352* (2013.01); *F01L 2001/3521* (2013.01); *F01L 2303/00* (2020.05)

(58) Field of Classification Search
CPC ..... F01L 1/352; F01L 2303/00; F01L 2001/3521; F01L 2820/032; F01L 2250/02; F01L 2250/04
USPC ..... 123/90.15
See application file for complete search history.

(56) References Cited

FOREIGN PATENT DOCUMENTS

| | | | |
|---|---|---|---|
| CN | 105351450 | A | 2/2016 |
| CN | 105917085 | A | 8/2016 |
| CN | 110785543 | A | 2/2020 |
| DE | 102008053915 | A1 | 5/2010 |
| DE | 102017111223 | B3 | 9/2018 |
| DE | 102017114053 | B3 | 9/2018 |

(Continued)

OTHER PUBLICATIONS

Source: Office Action Corresponding to Chinese Patent Application No. 202280030884.8, dated Jun. 6, 2026.

*Primary Examiner* — Phutthiwat Wongwian
*Assistant Examiner* — Kelsey L Stanek

(57) ABSTRACT

A harmonic drive of an electromechanical camshaft adjusters includes a drive wheel designed as a ring gear; an internally toothed output element mounted with radial play in the drive wheel; a further internally toothed element fastened to the drive wheel, the internal toothing of which has a diameter corresponding to the internal toothing of the output element; an adjuster assembly which is formed from a wave generator; an externally toothed flexible gear element which can be deformed by said wave generator, the external toothing of this flexible gear element meshing both with the internal toothing of the output element and with the internal toothing of the further element; an annular gap being formed between the further internally toothed element and an inner peripheral surface of a recess of the drive wheel. The width of the annular gap is at least partially greater than a radial play of the output element.

9 Claims, 2 Drawing Sheets

(56) References Cited

FOREIGN PATENT DOCUMENTS

| | | | | | |
|---|---|---|---|---|---|
| DE | 102017116729 | A1 | | 1/2019 | |
| DE | 102018123305 | A1 | | 4/2019 | |
| DE | 102018108585 | A1 | * | 10/2019 | ..... F01L 1/022 |
| DE | 102018113977 | A1 | * | 12/2019 | ..... F16J 15/10 |
| DE | 102018116648 | A1 | | 1/2020 | |
| DE | 102019102264 | A1 | * | 7/2020 | ..... F01L 1/352 |
| EP | 2638257 | B1 | | 7/2014 | |
| WO | 2012110128 | A2 | | 8/2012 | |
| WO | 2015051789 | A1 | | 4/2015 | |
| WO | 2020125843 | A1 | | 6/2020 | |

* cited by examiner

ACTUATING GEAR AND METHOD FOR ASSEMBLING AN ACTUATING GEAR OF AN ELECTROMECHANICAL CAMSHAFT ADJUSTER

CROSS-REFERENCE TO RELATED APPLICATIONS

This application is the U.S. National Phase of PCT Application No. PCT/DE2022/100418 filed on Jun. 3, 2022, which claims priority to DE 10 2021 114 625.9 filed on Jun. 8, 2021, the entire disclosures of which are incorporated by reference herein.

TECHNICAL FIELD

The disclosure relates to an actuating gear, in particular in the form of a harmonic drive, and to a method for assembling an actuating gear of an electromechanical camshaft adjuster.

BACKGROUND

A camshaft adjuster with an actuating gear is known, for example, from EP 2 638 257 B1. This known camshaft adjuster has a drive ring gear as part of a drive unit. An inner lateral surface of the drive ring gear forms a sliding bearing surface for an outer lateral surface of an output unit, and the sliding bearing surfaces are interrupted by rotation limiting contours.

Harmonic drives inherently have a flexible gear element. Such a gear element can be in the form of a simple ring, i.e., a flex ring. Alternatively, a flexible gear element of a harmonic drive can describe a pot shape, a hat shape, or a more complex shape. Various designs of camshaft adjusters with a harmonic drive are described, for example, in the documents DE 10 2017 116 729 A1, DE 10 2017 111 223 B3, DE 10 2017 114 053 B3 and DE 10 2008 053 915 A1. In all of these cases, a belt is provided for the camshaft drive.

A method for assembling a harmonic drive is disclosed, for example, in DE 10 2018 116 648 A1 or DE 10 2018 123 305 A1. In this case, a drive element of the harmonic drive is designed as a chain wheel.

SUMMARY

The disclosure addresses the problem of specifying ways of assembling electromechanical camshaft adjusters that are more advanced in comparison with the aforementioned prior art. The aim is to achieve a high level of process reliability under series production conditions and to avoid mechanical overspecifications.

This problem is solved, according to the disclosure, by a method for assembling an actuating gear of an electromechanical camshaft adjuster as described herein. Any embodiments and advantages of the disclosure explained below in connection with the actuating gear or the entire camshaft adjuster also apply analogously to the method for assembling and vice versa.

The actuating gear of the camshaft adjuster is in particular a harmonic drive. As the rotatable component of the actuating gear on the input side, a housing assembly is provided consisting of a drive wheel designed as a ring gear and an element having an internal toothing. In the case of a drive of the camshaft to be adjusted via a traction means, the drive wheel is a belt wheel or a chain wheel or a component firmly connected to such an element of a belt drive.

When the actuating gear is designed as a harmonic drive, a cavity is formed by said housing assembly, in which, among other things, a wave generator is arranged. In each case, the cavity contains an output element that has an internal toothing. During assembly, this internal toothing must be aligned in relation to the internal toothing of the element to be connected to the drive wheel. The latter element is also referred to below as a further internally toothed element to distinguish it from the output element.

The actuating gear designed as a harmonic drive is assembled in the following steps:

- providing a drive wheel designed as a ring gear; an internally toothed output element, the outside diameter of which is matched to the inside diameter of the drive wheel; a further internally toothed element, the internal toothing of which has a diameter corresponding to the internal toothing of the output element; and an externally toothed flexible gear element, in particular in the form of a flex ring, which surrounds a wave generator and together with the latter forms an adjuster assembly;
- inserting the output element into the drive wheel;
- partially inserting the adjuster assembly into the output element so that the external toothing of the flexible gear element partially meshes with the internal toothing of the output element;
- placing the further internally toothed element on the flexible gear element so that its external toothing also partially meshes with the internal toothing of the further element, thus aligning the two internally toothed elements in the drive wheel; and
- fixing the further internally toothed element in the aligned position on the drive wheel, thus completing the housing assembly in the final alignment of its components, i.e., the drive wheel and the further internally toothed element.

The further internally toothed element is fixed by means of a screw connection, and a seal can be deposited between the further internally toothed element and the drive wheel. As for the diameters of the internal toothings of the output element as well as the further internally toothed element, the following applies: the tip and root circles of these toothings are the same, with the exception of manufacturing tolerances. The pitch circles differ slightly from each other. The numbers of teeth of the two toothings typically differ from each other by two.

Optionally, there are assembly aid contours on the further internally toothed element and on the end face of the output element, which make it easier to place the further internally toothed element on the flexible gear element and to advance the further internally toothed element to its final axial position. The alignment of the output element and the further internally toothed element in the radial direction, in relation to the center axis of the aforementioned elements and thus of the entire actuating gear, is also performed in this case by the flexible externally toothed gear element. The assembly aid contour can, for example, be present in the form of an annular groove in the further internally toothed element and an annular section of the output element. The annular section engages in the annular groove with play, in particular with play in the radial direction. In an analogous manner, an annular circumferential web could alternatively be present on the further internally toothed element and an annular groove on the end face of the output element. In no case is the free rotatability of the output element impeded by the assembly aid contour.

As a further means of facilitating assembly, the drive wheel can have an end-face recess into which the further internally toothed element is to be inserted with a clearance fit when placed on the flexible gear element. This clearance fit results in an annular gap between the further internally toothed element and the drive wheel in the fully assembled actuating gear.

The annular gap can have a minimum distance between the drive wheel and the further internally toothed element. The minimum distance can be greater than the radial play of the output element.

To allow for positioning in the clearance fit, the annular gap extends along the entire axial region where the drive wheel and the further internally toothed element overlap radially. The annular gap can have a constant depth in its axial course.

The actuating gear thus comprises a drive wheel designed as a ring gear, an internally toothed output element mounted with radial play in the drive wheel, a further internally toothed element which is fastened to the drive wheel and the internal toothing of which has a diameter corresponding to the internal toothing of the output element, and an adjuster assembly which is formed from a wave generator and an externally toothed gear element which can be deformed by said wave generator. The external toothing of this gear element meshes both with the internal toothing of the output element and with the internal toothing of the further element, and an annular gap is formed between the further internally toothed element and an inner peripheral surface of a recess of the drive wheel. The width of which annular gap is at least partially, in particular fully, greater than the radial play of the output element.

According to a possible further development, the further internally toothed element of the actuating gear has an annular groove in which an annular section of the output element engages with play. This serves to facilitate the assembly of the actuating gear in the manner already explained.

The further internally toothed element optionally has additional functions. This element can, for example, have a cylindrical section provided as a sealing surface and facing away from the output element. The actuating gear is thus particularly suitable for a camshaft adjuster with a dry belt drive.

BRIEF DESCRIPTION OF THE DRAWINGS

Below, two exemplary embodiments of the disclosure are explained in more detail by means of a drawing. In the figures.

DETAILED DESCRIPTION

Figure 1:
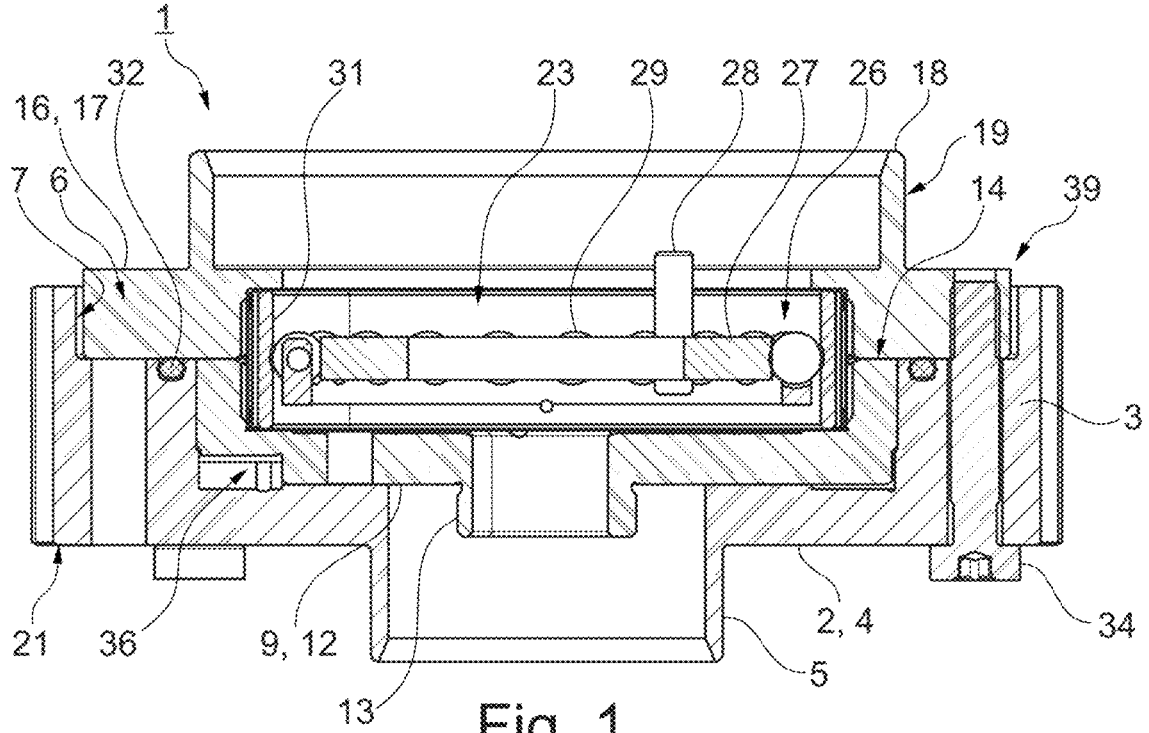
FIG. 1 shows a first embodiment of an actuating gear of an electromechanical camshaft adjuster in a sectional view.
Figure 2:
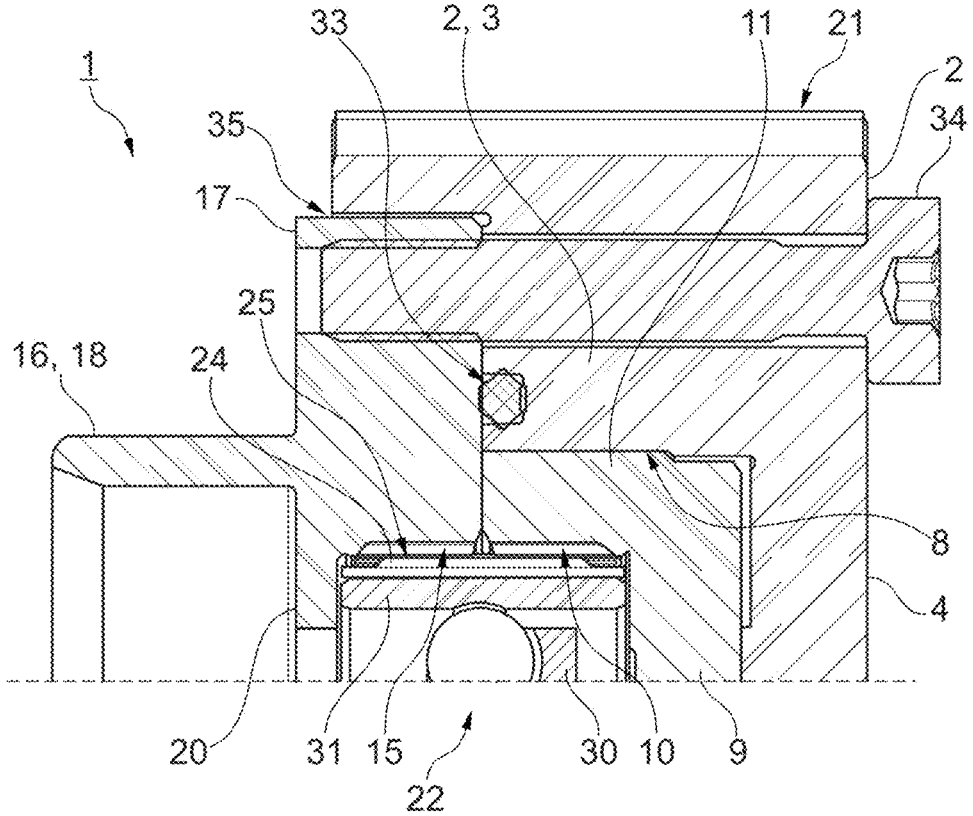
FIG. 2 shows a detail of the actuating gear according to FIG. 1, FIGS. 3 and 4 show a further embodiment of an actuating gear in representations analogous to FIGS. 1 and 2.

Unless otherwise stated, the following explanations relate to both exemplary embodiments. Parts that correspond to each other or have basically the same effect are marked with the same reference symbols in all figures.

An actuating gear 1 designed as a harmonic drive is part of an electromechanical camshaft adjuster of an internal combustion engine in a motor vehicle, which is not shown further. With regard to the basic structure and function of the harmonic drive, reference is made to the prior art cited at the outset.

A drive wheel 2, designed as a belt wheel in the present cases, is driven in a manner known per se by the crankshaft of the internal combustion engine and rotates at half the crankshaft speed. The drive wheel 2 is designed as a ring gear and has an outer cylindrical section 3, a disc-shaped section 4 and an inner cylindrical section 5. The camshaft to be adjusted is inserted into the latter section 5. A toothed belt, which is not shown and runs dry, engages in a toothing 21 on the outer peripheral surface of the drive wheel 2 during operation of the internal combustion engine. In the present case, the toothing 21 is formed directly by the drive wheel 2. Alternatively, the toothing 21 could be formed by a separate belt wheel connected to the drive wheel 2.

In the outer cylindrical section 3 there is a recess 6 on the end face, i.e., on the side opposite the inner cylindrical section 5, through which an inner peripheral surface 7 is formed. A sliding surface 8 is formed by the region of the outer cylindrical section 3 adjoining the recess 6, in which an output element 9 is mounted. Like the drive wheel 2, the output element 9 has the form of a ring gear, wherein in this case the outer cylindrical section is designated with 11, the bottom, i.e., the disc-shaped section, is designated with 12, and an inner cylindrical section is designated with 13. In the assembled state of the camshaft adjuster, the output element 9 is firmly connected to the camshaft to be adjusted, i.e., the intake or exhaust camshaft.

The outer cylindrical section 11 of the output element 9 has an internal toothing 10 extending approximately to the end face of the output element 9 designated with 14. The pitch circle diameter of the internal toothing 10 coincides with the pitch circle diameter of a toothing 15 provided by a further internally toothed element 16. The further internally toothed element 16, together with the drive wheel 2, forms a housing, generally also referred to as a housing assembly, of the actuating gear 1, designated with 39.

The internal toothing 15 is located on a disc-shaped section 17 of the internally toothed element 16. A cylindrical section 18 extends from the disc-shaped section 17 on the side facing away from the output element 9, through which a sealing surface 19 is formed. The sealing surface 19 is provided for contacting a shaft seal not shown. The disc-shaped section 17 continues radially inward, adjacent to the toothing 15, in the form of an inner radial section 20, which is arranged parallel to the bottom 12 of the output element 9.

The inner radial section 20 and the bottom 12 delimit an inner space in the axial direction, in which an adjuster assembly 22, also referred to as an adjusting shaft for short, is located. Components of the adjuster assembly 22 are a wave generator 23 and a flexible gear element 24, i.e., a flex ring. The toothing of the flexible gear element 24 is designated with 25.

The wave generator 23 comprises a rolling bearing 26, in the present case in the form of a ball bearing, with a non-circular, elliptical inner ring 27, which can be driven electrically via bolts 28, and a compensating coupling can be connected between an actuator and the inner ring 27. The rolling elements, designated with 29, i.e., balls, of the rolling bearing 26, are guided in a cage 30 and contact an outer ring 31 which, in contrast to the inner ring 27, is flexible and permanently adapts to the non-circular shape of the inner ring 27. The flexible gear element 24 surrounds the outer ring 31 without being firmly connected to it. Slightly differing numbers of teeth of the toothings 10, 15, 25 ensure, in a manner known per se, that a full rotation of the inner ring 27 relative to the drive wheel 2 is converted into only a slight pivoting between the drive wheel 2 and the output element 9, whereby the actuating gear 1 is designed as a high reduction gear. The resulting adjustment of the phase position of the camshaft is limited by a rotation angle limitation 36, which is formed by contours of the drive wheel 2 and the output element 9.

When assembling the actuating gear 1, the output element 9 is first inserted into the drive wheel 2. The outside diameter of the output element 9 is matched to the diameter of the sliding surface 8 in such a way that the output element 9 is mounted in the drive wheel 2 with minimal radial play. After inserting the output element 9 into the drive wheel 2, the adjusting shaft is inserted as far as possible into the output element 9 so that the external toothing 25 partially engages in the internal toothing 10, namely at exactly two diametrically opposite points.

Subsequently, the further internally toothed element 16 is assembled and aligned, and a seal 32 is previously deposited into a groove 33, which is located on the end face of the drive wheel 2. The toothing 15 is pushed onto the toothing 25 of the flexible gear element 24, thus aligning the elements 2, 9, 16. In the aligned state, the further internally toothed element 16 is permanently fixed to the drive wheel 2 by means of screws 34. This leaves an annular gap, designated with 35, which is formed between the outer peripheral surface of the disc-shaped section 17 and the inner peripheral surface 7. The width of the annular gap 35 significantly exceeds the radial play of the output element 9 in the drive wheel 2 and is dimensioned such that the alignment of the internally toothed element 16 is not impeded by the flexible gear element 24.

Figure 3:
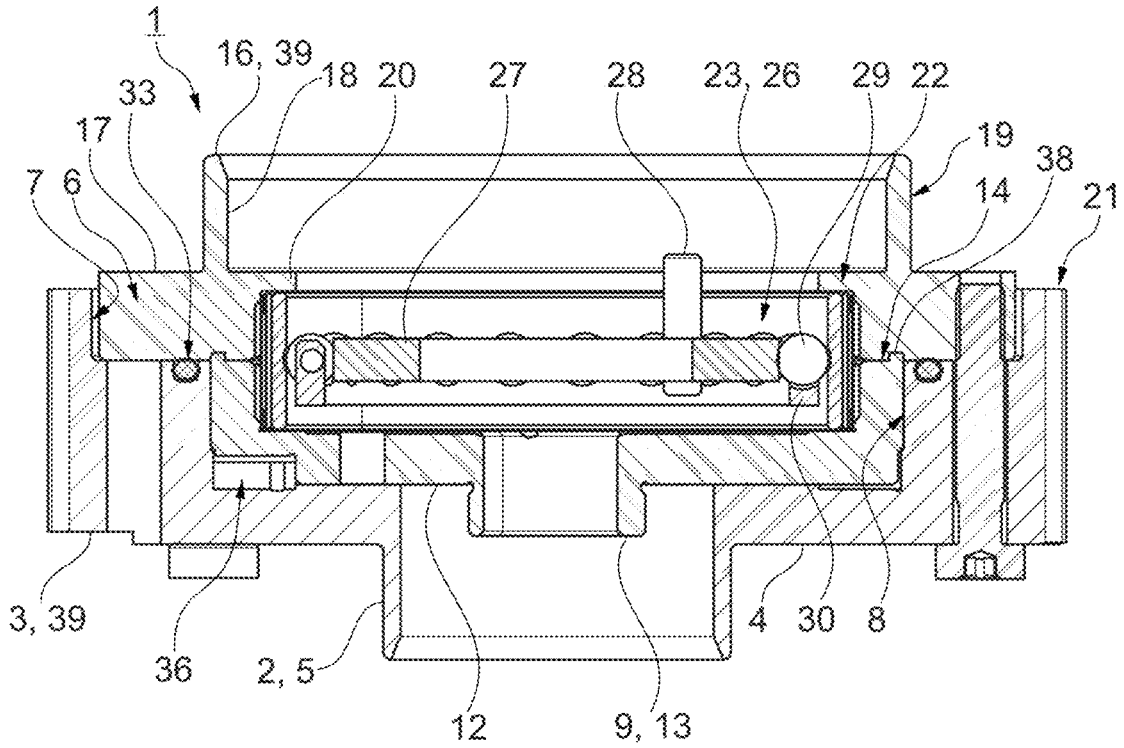
Figure 4:
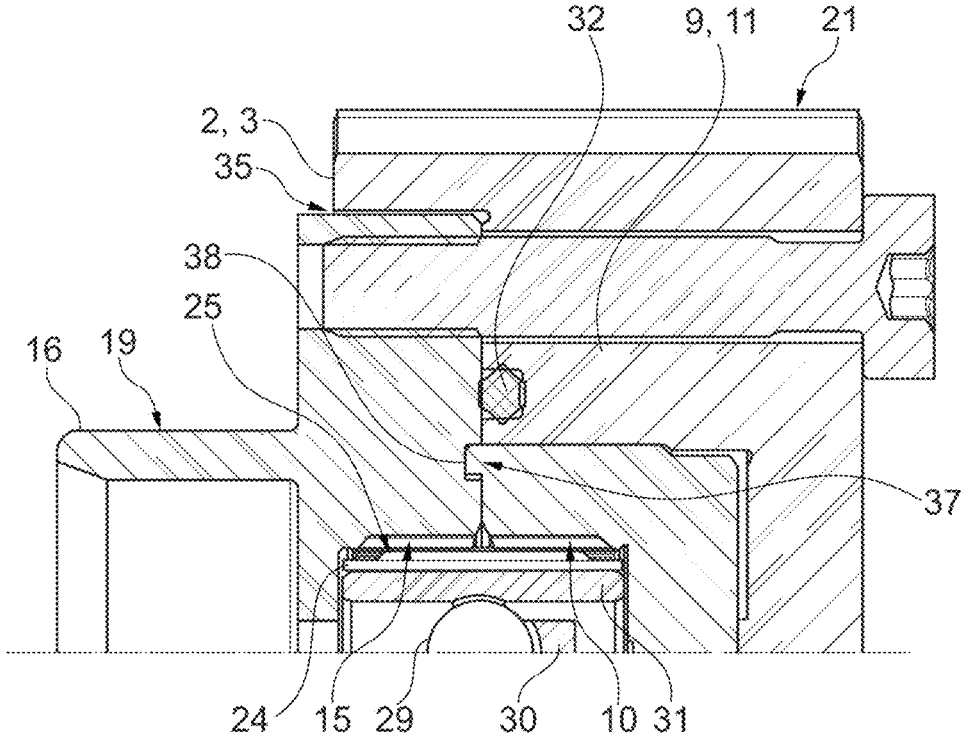

To facilitate the assembly described, in the exemplary embodiment according to FIGS. 3 and 4, an annular section 38 (or annular protrusion or tongue) is formed on the end face 14 of the output element 9, which is provided for engagement in an annular groove 37 of the internally toothed element 16. Also in the case of the contours 37, 38, radial play is present which does not have a restricting effect on the alignment of the elements 2, 9, 16 by the flexible gear element 24.

LIST OF REFERENCE SYMBOLS

1 Actuating gear
2 Drive wheel
3 Outer cylindrical section of the drive wheel
4 Disc-shaped section of the drive wheel
5 Inner cylindrical section of the drive wheel
6 Recess in the outer cylindrical section of the drive wheel
7 Inner peripheral surface of the recess
8 Sliding surface in the drive wheel
9 Output element
10 Internal toothing of the output element
11 Outer cylindrical section of the output element
12 Bottom of the output element
13 Inner cylindrical section of the output element
14 End face of the output element
15 Toothing of the further internally toothed element
16 Further internally toothed element
17 Disc-shaped section of the internally toothed element
18 Cylindrical section of the internally toothed element
19 Sealing surface
20 Inner radial section
21 Toothing of the drive wheel
22 Adjuster assembly
23 Wave generator
24 Flexible gear element
25 Toothing of the flexible gear element
26 Rolling bearing, ball bearing
27 Inner ring
28 Bolt
29 Rolling element, ball
30 Cage
31 Outer ring
32 Seal
33 Groove
34 Screw
35 Annular gap
36 Rotation angle limitation
37 Annular groove
38 Annular section
39 Housing

The invention claimed is:

1. A method for assembling an actuating gear of an electromechanical camshaft adjuster, comprising:

providing:

a drive wheel configured as a ring gear, an internally toothed output element having:

an outside diameter matched to an inside diameter of the drive wheel, and a first internal toothing, and a further internally toothed element having:

a second internal toothing with a diameter corresponding to the first internal toothing of the internally toothed output element, a disc-shaped section, and a cylindrical section, and an externally toothed flexible gear element surrounding a wave generator, and the externally toothed flexible gear element and the wave generator form an adjuster assembly, inserting the internally toothed output element into the drive wheel, partially inserting the adjuster assembly into the internally toothed output element so that an external toothing of the externally toothed flexible gear element partially meshes with the first internal toothing of the internally toothed output element, inserting the further internally toothed element into an axially extending recess arranged on an axial end face of the drive wheel so that: i) a radial gap is formed between an outer peripheral surface of the disc-shaped section of the further internally toothed element and an inner peripheral surface of the axially extending recess, and a width of the radial gap is larger than a radial play of the internally toothed output element in the drive wheel, ii) the external toothing of the externally toothed flexible gear element partially meshes with the second internal toothing of the further internally toothed element, and iii) the internally toothed output element and the further internally toothed element are aligned, defining an aligned position, and fixing the further internally toothed element in the aligned position on the drive wheel.

2. The method according to claim 1, wherein the further internally toothed element is screwed to the drive wheel.

3. The method according to claim 1, wherein a seal is arranged between the further internally toothed element and the drive wheel.

4. The method according to claim 3, wherein the seal is arranged in a groove formed on an axial end face of one of the further internally toothed element or the drive wheel.

5. The method according to claim 1, wherein the further internally toothed element and the drive wheel combine to form a housing for the internally toothed output element.

6. The method according to claim 5, wherein the further internally toothed element and the drive wheel combine to form a housing for the wave generator.

7. The method according to claim 1, wherein the cylindrical section of the further internally toothed element extends away from the internally toothed output element in an axial direction after inserting the further internally toothed element into the axially extending recess arranged on the axial end face of the drive wheel.

8. A method for assembling an actuating gear of an electromechanical camshaft adjuster, comprising:

providing:

a drive wheel configured as a ring gear, an internally toothed output element having:

an outside diameter matched to an inside diameter of the drive wheel, and a first internal toothing, and a further internally toothed element having a second internal toothing with a diameter corresponding to the first internal toothing of the internally toothed output element, and an externally toothed flexible gear element surrounding a wave generator, and the externally toothed flexible gear element and the wave generator form an adjuster assembly, inserting the internally toothed output element into the drive wheel, partially inserting the adjuster assembly into the internally toothed output element so that an external toothing of the externally toothed flexible gear element partially meshes with the first internal toothing of the internally toothed output element, placing the further internally toothed element on the externally toothed flexible gear element so that: i) the external toothing of the externally toothed flexible gear element partially meshes with the second internal toothing of the further internally toothed element, ii) the internally toothed output element and the further internally toothed element are aligned, defining an aligned position, and iii) an annular protrusion arranged on one of a first end face of the internally toothed output element or a second end face of the further internally toothed output element engages an annular groove with play, the annular groove arranged on a remaining one of the first end face or the second end face, and fixing the further internally toothed element in the aligned position on the drive wheel.

9. The method according to claim 8, wherein a seal is arranged between the further internally toothed element and the drive wheel.

* * * * *